US008165784B2

(12) United States Patent
Okamoto et al.

(10) Patent No.: US 8,165,784 B2
(45) Date of Patent: Apr. 24, 2012

(54) APPARATUS AND METHOD FOR LEARNING REFERENCE POSITION OF VARIABLE VALVE UNIT

(75) Inventors: Naoki Okamoto, Isesaki (JP); Masahiro Arai, Yokohama (JP); Hatsuo Nagaishi, Zushi (JP); Yuko Nagaishi, legal representative, Zushi (JP); Takahiro Yoshino, Yokosuka (JP)

(73) Assignee: Hitachi, Ltd., Tokyo (JP)

( * ) Notice: Subject to any disclaimer, the term of this patent is extended or adjusted under 35 U.S.C. 154(b) by 1157 days.

(21) Appl. No.: 11/961,699

(22) Filed: Dec. 20, 2007

(65) Prior Publication Data

US 2008/0167789 A1 Jul. 10, 2008

(30) Foreign Application Priority Data

Dec. 21, 2006 (JP) ..... 2006-344118

(51) Int. Cl.
*B60T 7/12* (2006.01)

(52) U.S. Cl. ..... 701/105

(58) Field of Classification Search ..... 123/90.15, 123/90.16, 90.17, 90.18, 399, 90.1, 345, 123/90.44; 701/101, 102, 105; *B60T 7/12*
See application file for complete search history.

(56) References Cited

U.S. PATENT DOCUMENTS

| | | | | |
|---|---|---|---|---|
| 5,636,603 | A * | 6/1997 | Nakamura et al. | 123/90.17 |
| 6,575,128 | B2 | 6/2003 | Nakamura et al. | |
| 6,578,534 | B2 * | 6/2003 | Nohara et al. | 123/90.16 |
| 7,021,258 | B2 | 4/2006 | Nohara et al. | |
| 7,265,505 | B2 | 9/2007 | Nakai et al. | |
| 2005/0193968 | A1 | 9/2005 | Nohara et al. | |

FOREIGN PATENT DOCUMENTS

| | | | |
|---|---|---|---|
| CN | 1654790 | A | 8/2005 |
| JP | 2003-194580 | A | 7/2003 |
| JP | 2005-016339 | A | 1/2005 |
| JP | 2005-188286 | A | 7/2005 |
| JP | 2005-198448 | A | 7/2005 |
| JP | 2005-226543 | A | 8/2005 |

OTHER PUBLICATIONS

Naoki Okamoto, PTO Office Action, U.S. Appl. No. 11/657,729, filed Dec. 16, 2008, 12 pages.
Naoki Okamoto, PTO Notice of Allowance, U.S. Appl. No. 11/657,729, filed Jun. 1, 2009, 4 pages.

* cited by examiner

*Primary Examiner* — Michael Cuff
*Assistant Examiner* — Keith Coleman
(74) *Attorney, Agent, or Firm* — Foley & Lardner LLP

(57) ABSTRACT

In a variable valve unit provided with a variable valve mechanism that varies opening characteristics of an engine valve by rotary motion of a control shaft, an actuator that generates a rotary motion of the control shaft, a stopper restricting the rotary motion of the control shaft, and an angle sensor capable of outputting signals corresponding to angle positions of the control shaft, when the signal of the angle sensor at an angle position where the rotation of the control shaft is restricted by the stopper are learned, the actuator is controlled such that the control shaft is pressed against the stopper, after which drive torque of the actuator is reduced and with the drive torque reduced, signals of the then-angle sensor are stored.

23 Claims, 9 Drawing Sheets

APPARATUS AND METHOD FOR LEARNING REFERENCE POSITION OF VARIABLE VALVE UNIT

BACKGROUND OF THE INVENTION

1. Field of the Invention

The present invention generally relates to a technique for learning reference position of a variable valve unit.

2. Description of the Related Art

In Japanese Laid-open (Kokai) Patent Application Publication No. 2005-188286, there is disclosed a variable valve mechanism in which a valve lift amount and a valve operation angle of an engine valve are continuously varied by a rotation of a control shaft, which is rotated by an actuator.

In addition, in the above published document, it is disclosed that the actuator is controlled such that the minimum valve lift amount and the minimum valve operating angle are achieved during fuel cut while a vehicle is being decelerated, and in such event, outputs of an angle sensor which detects a rotating angle of the control shaft are learned.

Incidentally, in learning the sensor output, the control shaft is rotationally driven by an actuator until the rotational motion of the control shaft is restricted by a stopper, and then the output of the angle sensor obtained when the control shaft comes in contact with the stopper is learned.

However, continuously applying the actuator torque to the control shaft with the control shaft being kept in contact with the stopper causes deflection in an angle sensor mounting unit, etc., and in turn a change in the outputs of the angle sensor occurs even though the rotation of the control shaft is being stopped, and as a result, an unpleasant problem occurs in which learning accuracy might be degraded.

SUMMARY OF THE INVENTION

Therefore, an object of the present invention is to avoid degradation of learning accuracy caused by defection of an angle sensor mounting unit, etc.

In order to achieve this object, a novel technique is provided by the present invention, in which after an operation of the actuator is controlled such that the control shaft is pressed against the stopper, a drive torque exerted by the actuator is reduced, and the output signals of the angle sensor in a state of the reduced drive torque of the actuator are learned as signals at a reference position where the control shaft is restricted from making a rotary motion thereof by the stopper.

The other objects and features of this invention will be become understood from the following description with reference to the accompanying drawings.

DESCRIPTION OF THE PREFERRED EMBODIMENTS

Figure 1:
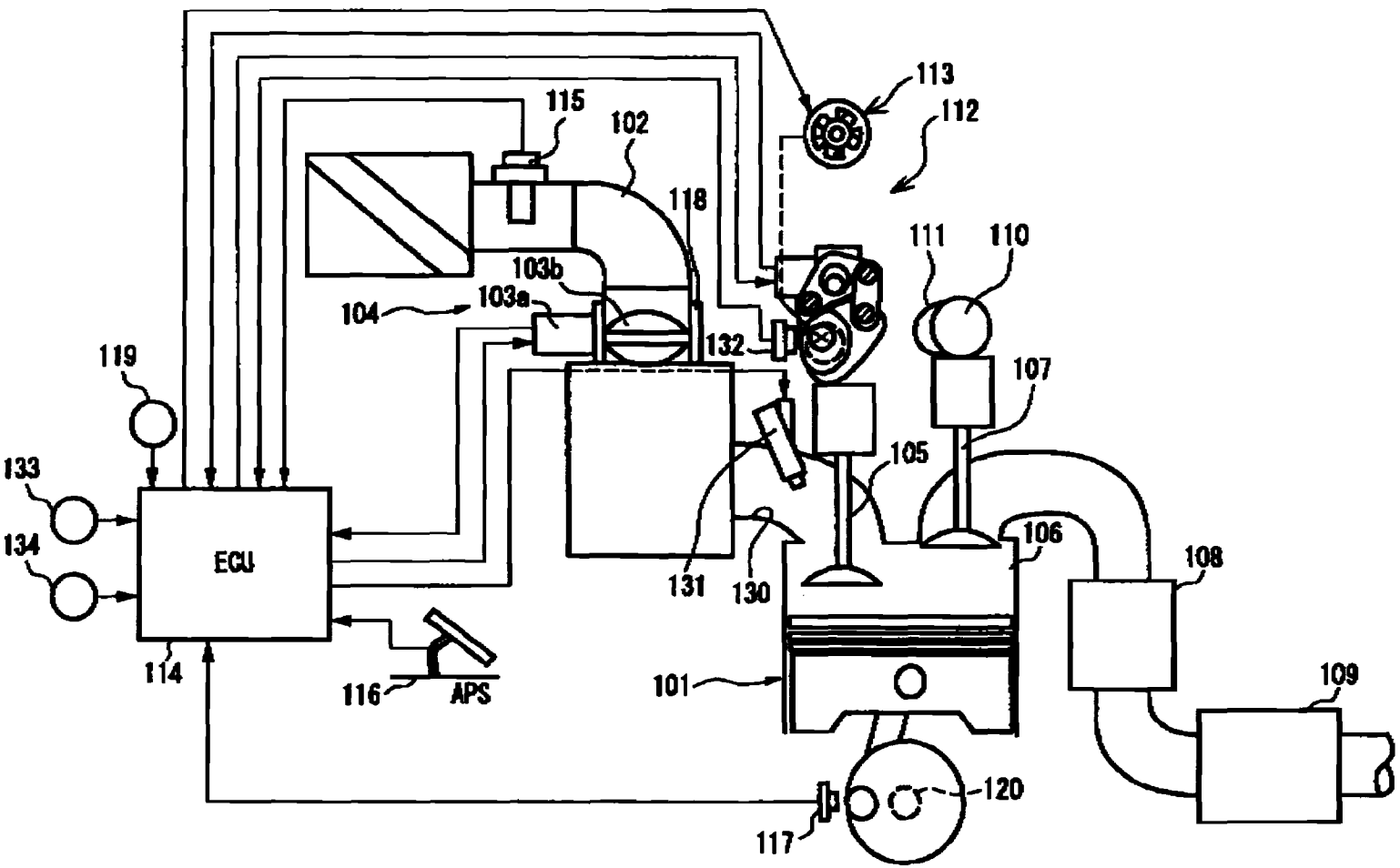
FIG. 1 is a system diagram of a vehicle engine according to an embodiment of the present invention.

FIG. 1 is a systematic diagram of a vehicle engine according to an embodiment of the present invention.

In FIG. 1, an electronically controlled throttle 104 is disposed in an inlet pipe 102 of an engine 101.

Electronically controlled throttle 104 is comprised of a throttle valve 103*b* and a throttle motor 103*a* that drives throttle valve 103*b*.

Air is drawn into a combustion chamber 106 of engine 101 via electronically controlled throttle 104 and an intake valve 105.

A fuel injection valve 131 is provided in an inlet port 130 upstream of intake valve 105 of each cylinder. Fuel injection valve 131 injects fuel in an amount proportional to an injection pulse width of an injection pulse signal sent from an engine control unit 114.

The fuel entering into combustion chamber 106 by suction is ignited and combusted by spark ignition from a spark plug (not shown).

The combustion exhaust gas inside combustion chamber 106 is discharged via an exhaust valve 107 and is cleaned by a front catalytic converter 108 and a rear catalytic converter 109.

By the way, the engine may be an engine which directly injects fuel into combustion chamber 106 or an engine which compresses and ignites fuel.

Exhaust valve 107 is driven to open and close with a predetermined valve lift amount, valve operating angle, and valve timing maintained by a cam 111 installed to an exhaust cam shaft 110.

On the other hand, as variable valve mechanisms that vary the opening characteristics of intake valve 105, a variable valve lift mechanism 112 and a variable valve timing mechanism 113 are installed.

Variable valve lift mechanism 112 is a mechanism to continuously vary the valve lift amount of intake valve 105 together with the valve operating angle.

Variable valve timing mechanism 113 is a mechanism to continuously vary a center phase of the valve operating angle of intake valve 105 by varying a rotation phase of a intake drive shaft 3 (see FIG. 2) with respect to a crankshaft 120.

Engine control unit 114 incorporates a microcomputer therein, and by an arithmetic process in accordance with a program stored in advance, computes a fuel injection amount, ignition timing, target Inlet air amount and the like. Engine control unit 114 outputs control signals to fuel injection valve 131, a power transistor for an ignition coil, electronically controlled throttle 104, variable valve lift mechanism 112 and variable valve timing mechanism 113.

Signals from various sensors are inputted to engine control unit 114.

Examples of the various sensors include an air flow meter 115 that detects the intake air amount of engine 101, an acceleration pedal sensor 116 that detects a tread or depressing amount of an acceleration pedal operated by a vehicle driver, a crank angle sensor 117 that outputs a reference crank angle signal for every reference rotation position of crank shaft 120, a throttle sensor 118 that detects an opening TVO of throttle valve 103*b*, a water temperature sensor 119 that detects the temperature of cooling water of engine 101, a cam sensor 132 that outputs cam signals for every reference rotation position of intake drive shaft 3.

Furthermore, signals of an ignition switch (engine switch) 134 are inputted to engine control unit 114.

Figure 2:
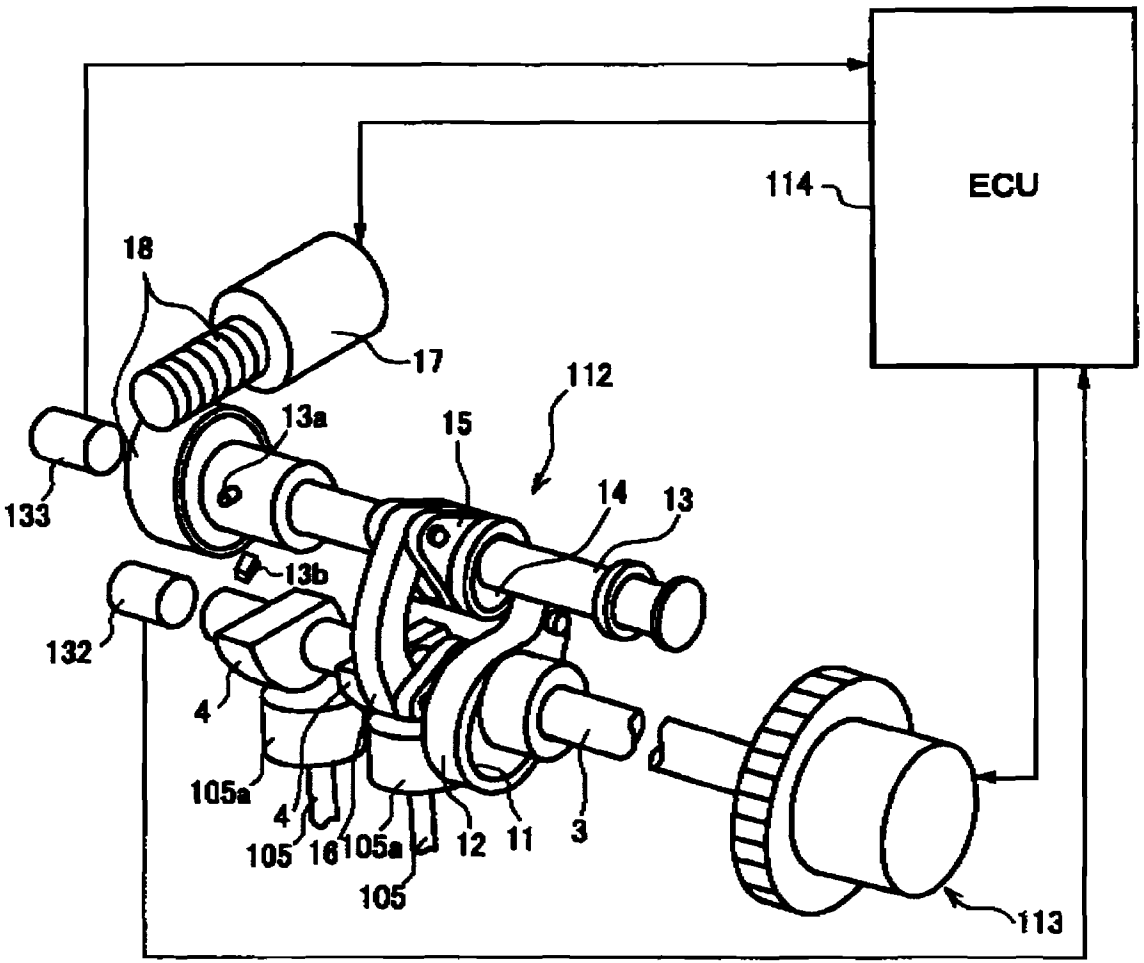
FIG. 2 is a perspective view showing a structure of a variable valve lift mechanism according to an embodiment of the present invention.

FIG. 2 is a perspective view showing variable valve lift mechanism 112.

Intake valves 105 are installed in a pair for each cylinder, and above these intake valves 105, intake drive shaft 3 which is driven to rotate by crankshaft 120 is rotatably supported along the cylinder column direction.

Onto intake drive shaft 3, an oscillating cam 4 that drives to open and close intake valve 105 is relatively rotatably fitted over while being kept In contact with a valve lifter 105*a* of intake valve 105.

Variable valve lift mechanism 112 which continuously varies the valve operating angle and the valve lift amount of intake valve 105 is arranged between intake drive shaft 3 and oscillating cam 4.

Variable valve timing mechanism 113 which continuously varies the central phase of the valve operating angle of intake valve 105 by varying the rotation phase of intake drive shaft 3 with respect to crankshaft 120 is disposed in one end of intake drive shaft 3.

Figure 3:
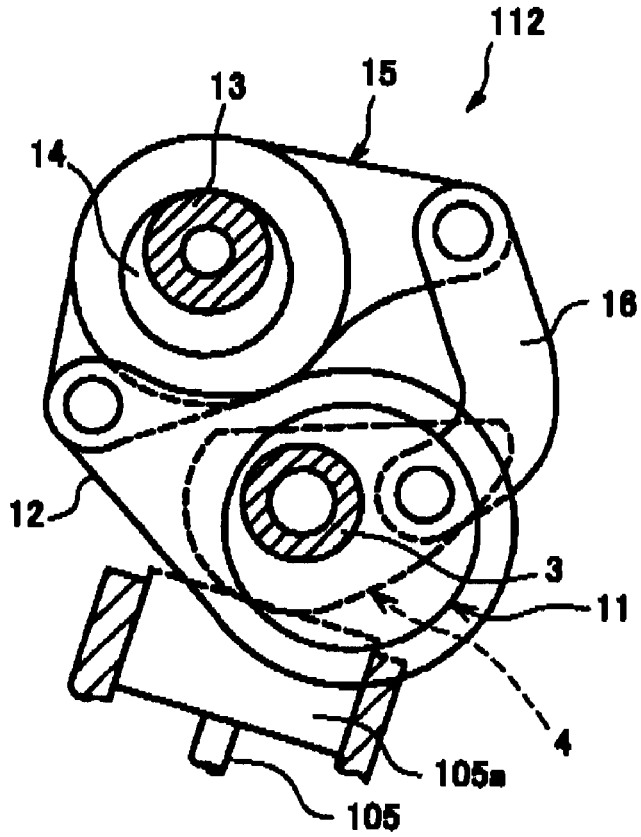
FIG. 3 is a cross-sectional view showing a part of the variable valve lift mechanism.

Variable valve lift mechanism 112 has, as shown in FIGS. 2 and 3, a circular drive cam 11 (drive eccentric shaft) eccentrically and fixedly mounted on intake drive shaft 3, a ring-shaped link 12 (first link) relatively rotatably fitted over to this drive cam 11, a control shaft 13 which is arranged to extend in a direction in which a column of cylinders is arranged and nearly in parallel to intake drive shaft 3, a circular control cam 14 (control eccentric shaft) eccentrically and fixedly mounted onto this control shaft 13, a rocker arm 15 which is relatively rotatably fitted over onto this control cam 14 and at the same time one end of which is connected to the head end of ring-shaped link 12, and a rod-shaped link 16 (second link) connected to the other end of this rocker arm 1S and to oscillating cam 4.

Control shaft 13 is adjustably driven to rotate via a gear column 18 by a motor (actuator) 17.

A protrusion 13*a* is provided Integrally on control shaft 13, and by bringing protrusion 13*a* into contact with a stopper 13*b* integrally provided on a cylinder head, etc., rotation of control shaft 13 is restricted at an angle position thereof which corresponds to a minimum valve lift amount.

Another stopper that defines a maximum valve lift position may be provided together with stopper 13*b* which defines the minimum valve lift amount.

By the above-mentioned configuration, when intake drive shaft 3 rotates in conjunction with crankshaft 120, ring-shaped link 12 moves nearly in parallel via drive cam 11 and at the same time, rocker arm 15 oscillates around a center axis of control cam 14, oscillating cam 4 oscillates via rod-shaped link 18, and intake valve 105 is driven to open and close.

In addition, by varying the rotating angle of control shaft 13 by motor 17, the shaft center position of control cam 14, which serves as the center of oscillation of rocker arm 15, is varied and the posture of oscillating cam 4 is varied.

In this manner, while the center phase of the valve operating angle of intake valve 105 is kept nearly constant, the valve operating angle and the valve drift amount of intake valve 105 are continuously varied.

To engine control unit 114, detection signals are input from an angle sensor 133 that detects the rotating angle of control shaft 13. In order to swing control shaft 13 to the target angle position corresponding to the target valve lift amount, direction and magnitude of electric voltage applied to motor 17 is feedback-controlled on the basis of the target angle position and the actual angle position detected by angle sensor 133.

In variable valve lift mechanism 112 of the present embodiment valve open/close reactive force works on the valve lift amount reducing direction, and therefore, in order to maintain the increased state of the valve lift amount, motor torque that resists the reactive force is required.

Angle sensor 133 is a contactless angle sensor. As the contactless angle sensor, for example, as disclosed in Japanese Laid-open (Kokai) Patent Application Publication No. 2003-194580, a sensor which includes a magnet attached to an end of control shaft 13 and a magnetic-electric converting means disposed in opposite to an outer circumferential surface of the magnet, and which detects changes of magnetic flux associated with rotation of control shaft 13 is used.

However, angle sensor 133 is not exclusively limited to a contactless sensor but a contact-type angle sensor using, for example, a potentiometer may be employed.

As variable valve timing mechanism 113, a known vane type variable valve timing mechanism is used.

The vane type variable valve timing mechanism is a mechanism in which an advance-angle-side-hydraulic chamber and a retarded-angle-side-hydraulic chamber are formed on both sides of the vane by allowing the vane supported by intake drive shaft 3 to exist in a casing supported by a cam sprocket, and the relative angle of the vane with respect to the cam sprocket is varied by controlling feed and discharge of oil pressure to the advance-angle-side-hydraulic chamber and the retarded-angle-side-hydraulic chamber, thereby varying the rotating phase of intake drive shaft 3 with respect to crankshaft 120.

Now, in control of variable valve lift mechanism 112, the actual rotating angle of control shaft 13 is detected from signals of angle sensor 133, and electric power supply to motor 17 is feedback-controlled such that a detected value of this actual rotating angle comes closer to the target rotating angle corresponding to the target valve lift amount.

In the feedback control, electric voltage applied to motor 17 is controlled by varying the duty ratio of operating signals (operation amount) to turn on and off electric power supply to motor 17 in accordance with the deviation between the detected value and the target value of the rotating angle.

Note that the duty ratio in the present application is an on-time ratio in a control cycle, and by varying the duty ratio, the average electric voltage applied to motor 17 is varied.

The duty ratio is computed with signs, and the voltage application direction to motor 17 can be changed over between when it is a positive duty ratio and when it is a negative duty ratio.

When the duty ratio is positive, motor torque is generated to rotate control shaft 13 in a direction causing an increase in the valve lift amount, and when the duty ratio is negative, motor torque is generated to rotate control shaft 13 in a direction causing a reduction in the valve lit amount. As described above, the actual rotating angle of control shaft 13 is detected from signals of angle sensor 133 and electric voltage supply to motor 17 is feedback-controlled. Therefore, if any deviation appears in correlation between the signals of angle sensor 133 and the actual angle of control shaft 13, the actual rotation angle is falsely detected and control accuracy to the target valve lift amount (target rotating angle) is degraded.

Consequently, engine control unit 114 has a function to learn signals of angle sensor 133 at the minimum valve lift position where protrusion 13*a* comes in contact with stopper 13*b* and to correct the correlation between the signals of angle sensor 133 and the angle position of control shaft 13 on the basis of the signals learned.

Figure 4:
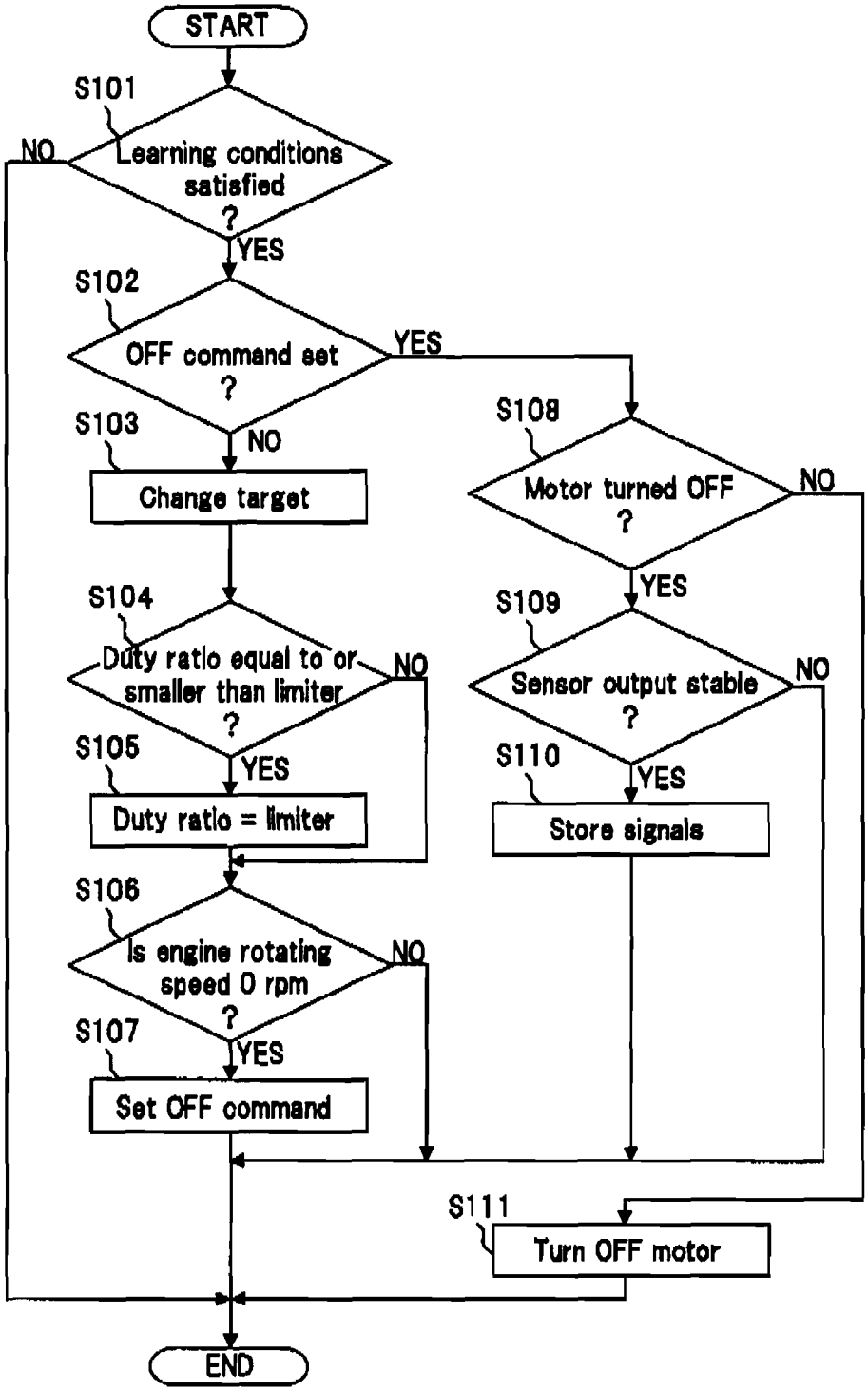
FIG. 4 is a flowchart of a learning process according to a first embodiment of the present invention.

The flowchart of FIG. 4 shows details of a learning process by engine control unit 114. The routine shown in the flowchart of FIG. 4 is interruption-executed at intervals of predetermined time.

In the flowchart of FIG. 4, In Step S101, whether or not the learning conditions at the minimum valve lift position are satisfied is determined.

Here, it is judged that the learning conditions are satisfied when ignition switch (engine switch) 134 is changed over from ON to OFF under conditions such that variable valve lift mechanism 112 and angle sensor 133 are diagnosed to be normal.

When it is judged that the learning conditions are satisfied, control proceeds to Step S102.

In Step S102, whether or not an OFF command of motor 17 is established is judged, and if no OFF command is established, control proceeds to Step S103.

In Step S103, the target rotating angle of control shaft 13 is forcibly varied in the valve lift amount reducing direction at a predetermined speed and the duty ratio (applied electric voltage) of operation signals of motor 17 is feedback-controlled in accordance with the target rotating angle.

Figure 5:
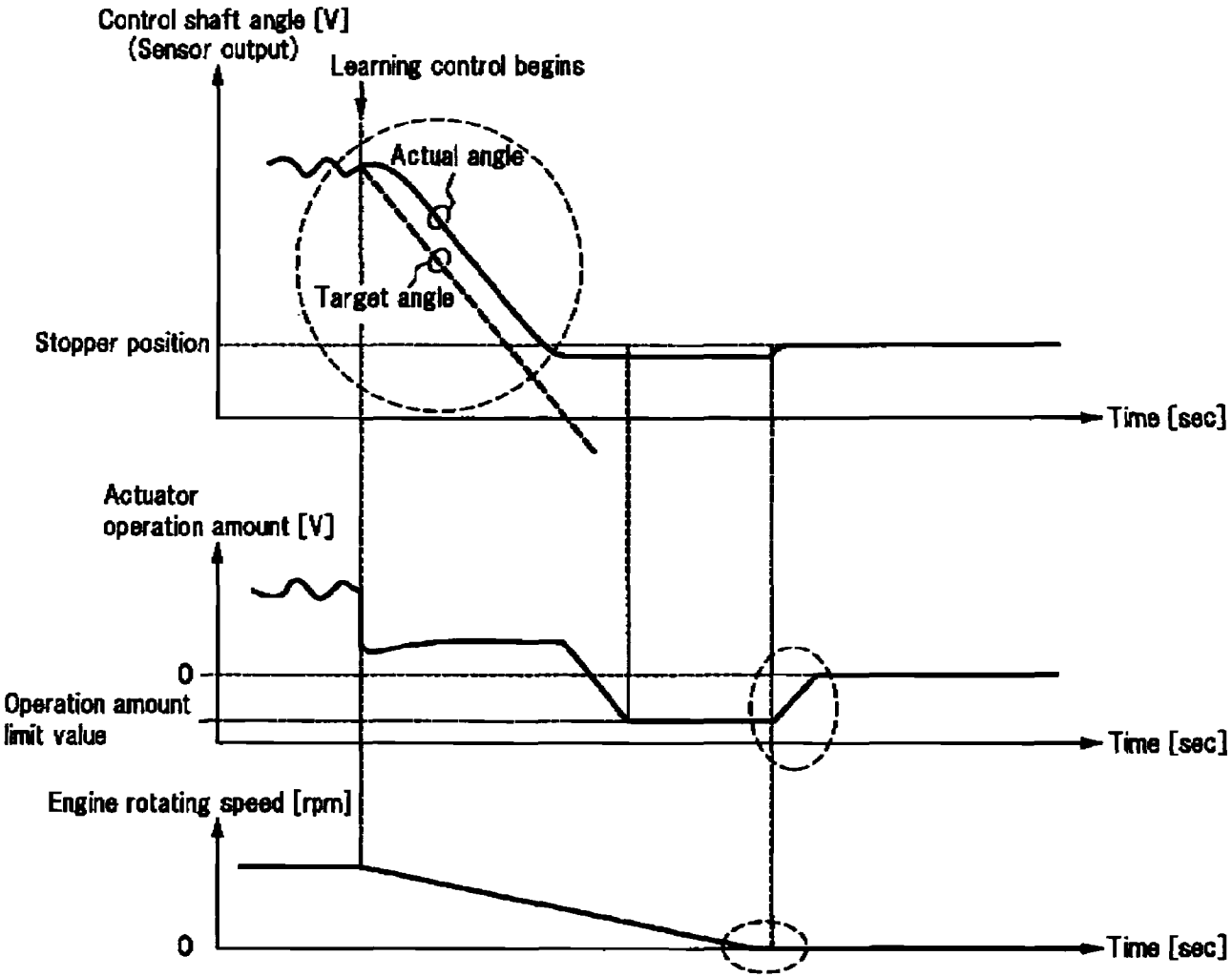
FIG. 5 is a time chart showing characteristics of the angle of a control shaft and a motor operation amount in the learning process of the first embodiment.

In a process of changing the target rotating angle in Step S103, the target rotating angle is not restricted by the rotating angle corresponding to the stopper position and even after the target rotating angle reaches a rotating angle that corresponds to the stopper position, the target rotating angle is varied with the previous speed and direction maintained (see FIG. 5).

When the target rotating angle is changed in the valve lift amount reducing direction as described above, by decreasing motor torque that works in the direction causing an increase in the valve lift amount as shown in FIG. 5, in other words, by decreasing the positive duty ratio, control shaft 13 is rotated in the valve lift amount reducing direction by valve open/close reactive force.

However, when rotation of control shaft 13 is restricted by stopper 13*b* and rotation of control shaft 13 is stopped, the target rotating angle gradually changes, whereas the actual rotating angle detected by angle sensor 133 does not change, and therefore the deviation between the target rotating angle and the actual rotating angle increases.

As a result, the duty ratio (applied electric voltage) of operation signals of motor 17 is changed to decrease toward zero as shown in FIG. 5, and even when the duty ratio (applied electric voltage) reaches zero, the control deviation is not reduced, and therefore, the duty ratio changes to a negative value.

In the event that the duty ratio is negative, the direction of applying electric voltage to motor 17 becomes the direction to generate motor torque in the direction to reduce the valve lift amount, and control shaft 13 is pressed against stopper 13*b* by the motor torque.

In this event, a limiter (<0) is provided to the negative duty ratio that generates motor torque for rotating control shaft 13 in the valve lift amount reducing direction.

In Step S104, judgment is made as to whether or not the duty ratio of motor 17 is equal to or smaller than the limiter.

In the event that the duty ratio is equal to or smaller than the limiter, control proceeds to Step S105 and by setting the limiter value to the duty ratio, ft is avoided that the duty ratio lower than the limiter is established. This will prevent control shaft 13 from being pressed against stopper 13*b* by excessive motor torque.

In step S106, after ignition switch 134 is turned off, it is judged whether or not the engine rotating speed (rpm) becomes zero, that is, whether or not rotation of engine 101 is stopped, on the basis of the signals from crank angle sensor 117.

When rotation of engine 101 stops, control proceeds to step S107 and an OFF command of motor 17 is set.

If the OFF command is set in Step S107, when control proceeds to Step 102 next, the process moves from Step S102 to Step S108 by judging that the OFF command has been set.

In Step S108, it is judged whether or not the duty ratio (applied electric voltage) of operation signals of motor 17 is zero and in the event that the duty ratio (applied electric voltage) is not zero, control proceeds to Step S111 and by setting the duty ratio to be zero, electric voltage supply to motor 17 is interrupted to turn OFF motor 17.

When motor 17 is turned OFF, for the next time, the process moves from Step S108 to Step S109.

In Step S109, it is judged whether or not signals of angle sensor 133 are stable in the vicinity of signals corresponding to the minimum valve lift amount (in the vicinity of stopper position).

For example, when the signals of angle sensor 133 are in a region that includes the signal corresponding to the minimum valve lift amount and the difference between the maximum and the minimum values of signals within reference time is less than the threshold value, it is judged that the signals of angle sensor 133 are stable.

In the event that the signals of angle sensor 133 are judged to be stable, control proceeds to Step S110 and then-signals of angle sensor 133 are stored as signals at the angle position where rotation of control shaft 13 is restricted by stopper 13*b*, that is, signals at the minimum valve lift position.

Therefore, every time signals at the minimum valve lift position are required newly, the previous storage values are deleted and sensor signals newly found are stored.

When the signals of angle sensor 133 at the minimum valve lift position are stored (learned), correlation between the signals of angle sensor 133 and rotation angle of control shaft 13 is modified on the basis of the sensor output (learned value) at the stopper position newly stored, and based on the correlation after the modification, the rotation angle of control shaft 13 is found from the signals of angle sensor 133.

For example, in a table that converts the signals of angle sensor 133 to the rotation angle of control shaft 13, the data of the angle corresponding to each signal value is modified uniformly on the basis of the signals (learned values) of angle sensor 133 at the minimum valve lift position.

Under the condition that control shaft 13 is pressed against stopper 13*b* by the torque of motor 17, deflection occurs at the angle sensor 133 mounting section and this varies the signals of angle sensor 133 though rotation of control shaft 13 is stopped and sensor signals at the stopper position cannot be learned at good accuracy.

Furthermore, when engine 101 is rotated, control shaft 13 oscillates in conjunction with oscillation of engine 101 and this varies the signals of angle sensor 133, so that sensor signals at the stopper position cannot be learned at good accuracy.

Therefore, in the above-mentioned embodiment, after control shaft 13 is pressed against stopper 13*b* by motor torque, electric power supply to motor 17 is interrupted, and therefore, deflection at the sensor mounting section is alleviated. At the same time, after rotation of the engine is stopped, sensor signals at the stopper position are learned, and therefore, highly accurate learning can be achieved.

Furthermore, after engine rotation is stopped, it is judged whether or not the signals of angle sensor 133 are stable. Therefore, ft is possible to avoid the situation that sensor signals at the stopper position are learned under the conditions that fluctuation of the signals of angle sensor 133 is not restored to their normal state.

It takes a sufficiently long time for rotation of engine 101 to stop after ignition switch 134 is turned off, compared with the time required to rotate control shaft 13 to the stopper position after ignition switch 134 is turned off.

Therefore, in the above-mentioned embodiment, when rotation of engine 101 is judged to be stopped, it is regarded that control shaft 13 is driven to rotate to the position where control shaft 13 is pressed against stopper 13*b*, and sensor signals are learned.

However, for example, In order to reduce impact generated when control shaft 13 collides against stopper 13*b*, in the event that the speed of changing the target rotating angle of control shaft 13 in a direction to reduce the valve lift amount is slowed down, it is possible to set the learning process such that electric power supply to motor 17 is interrupted after it is confirmed that control shaft 13 is driven to rotate to the position where control shaft 13 is pressed against stopper 13*b*.

Specifically, when the target rotating angle of control shaft 13 exceeds the stopper position and/or the duty ratio of motor 17 sticks to the limiter (<0), it is judged that control shaft 13 is driven to rotate to the position where control shaft 13 is pressed against stopper 13*b*, and in the event that engine 101 stops under this condition, electric power supply to motor 17 can be interrupted.

In addition, in the above-mentioned example, electric power supply to motor 17 is interrupted to bring motor torque to null, but the duty ratio of operation signals of motor 17 are returned from the limiter to a default (0>default>limter) and motor torque that presses control shaft 13 against stopper 13*b* can be reduced.

Figure 6:
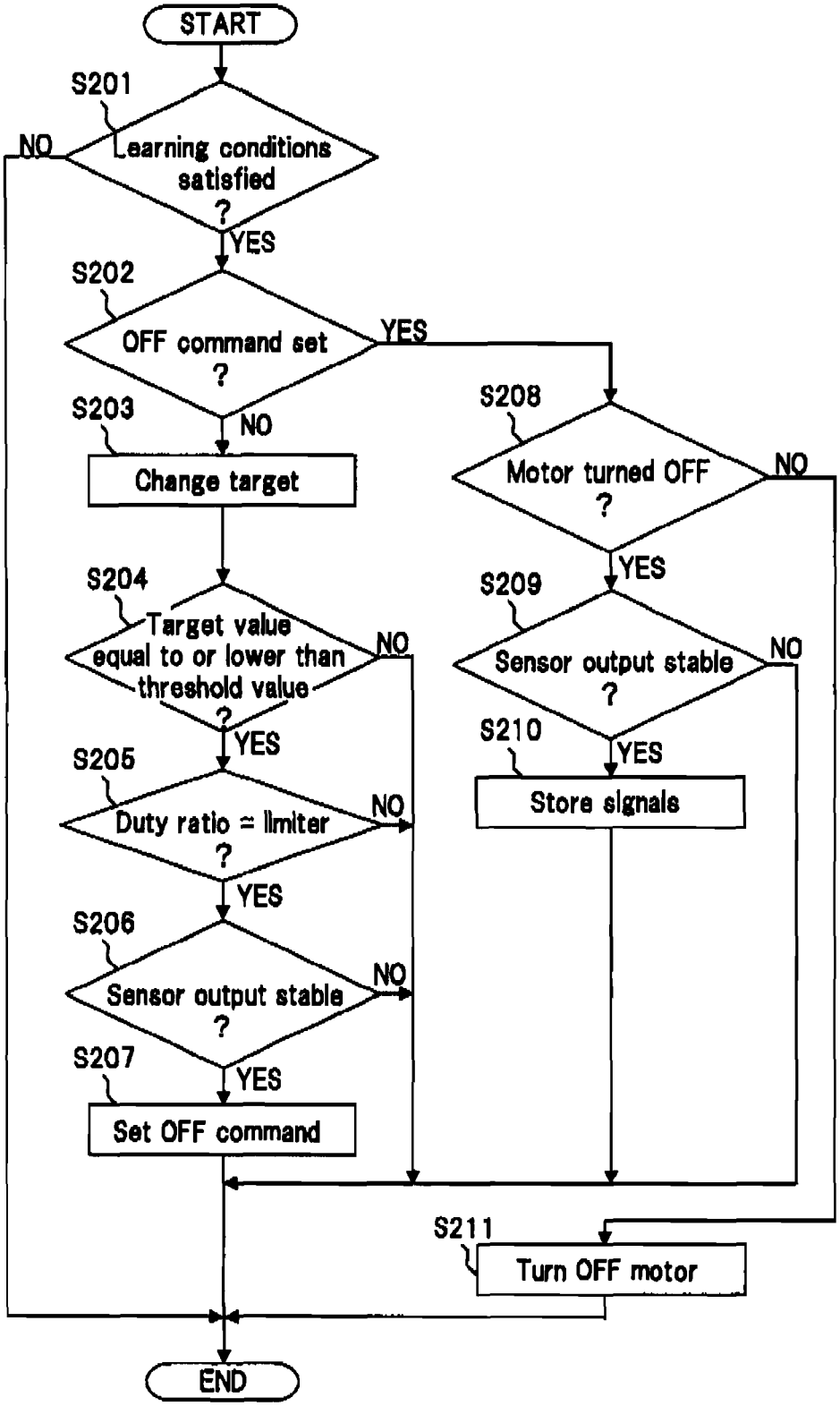
FIG. 6 is a flowchart of the learning process according to a second embodiment of the present invention.

The flowchart of FIG. 6 shows a second embodiment of the learning process.

In the flowchart of FIG. 6, in Step S201, it is judged whether or not learning conditions are satisfied.

In the second example, sensor signals at the stopper position are learned during operation of engine 101. It is judged that the learning conditions are satisfied when variable valve lift mechanism 112 and angle sensor 133 are normal, as well as when operating conditions which seriously impair operability of engine 101 do not occur even in the case where the valve lift amount of intake valve 105 is forcibly controlled to the minimum valve lift amount.

For example, during fuel cut, bringing the valve lift amount to the minimum valve lift amount does not provide any great affect on operability of engine 101.

When learning conditions are satisfied, control proceeds to Step S202.

In Step S202, it is judged whether or not an OFF command of motor 17 is set, and In the case where no OFF command is set, control proceeds to Step S203.

Figure 7:
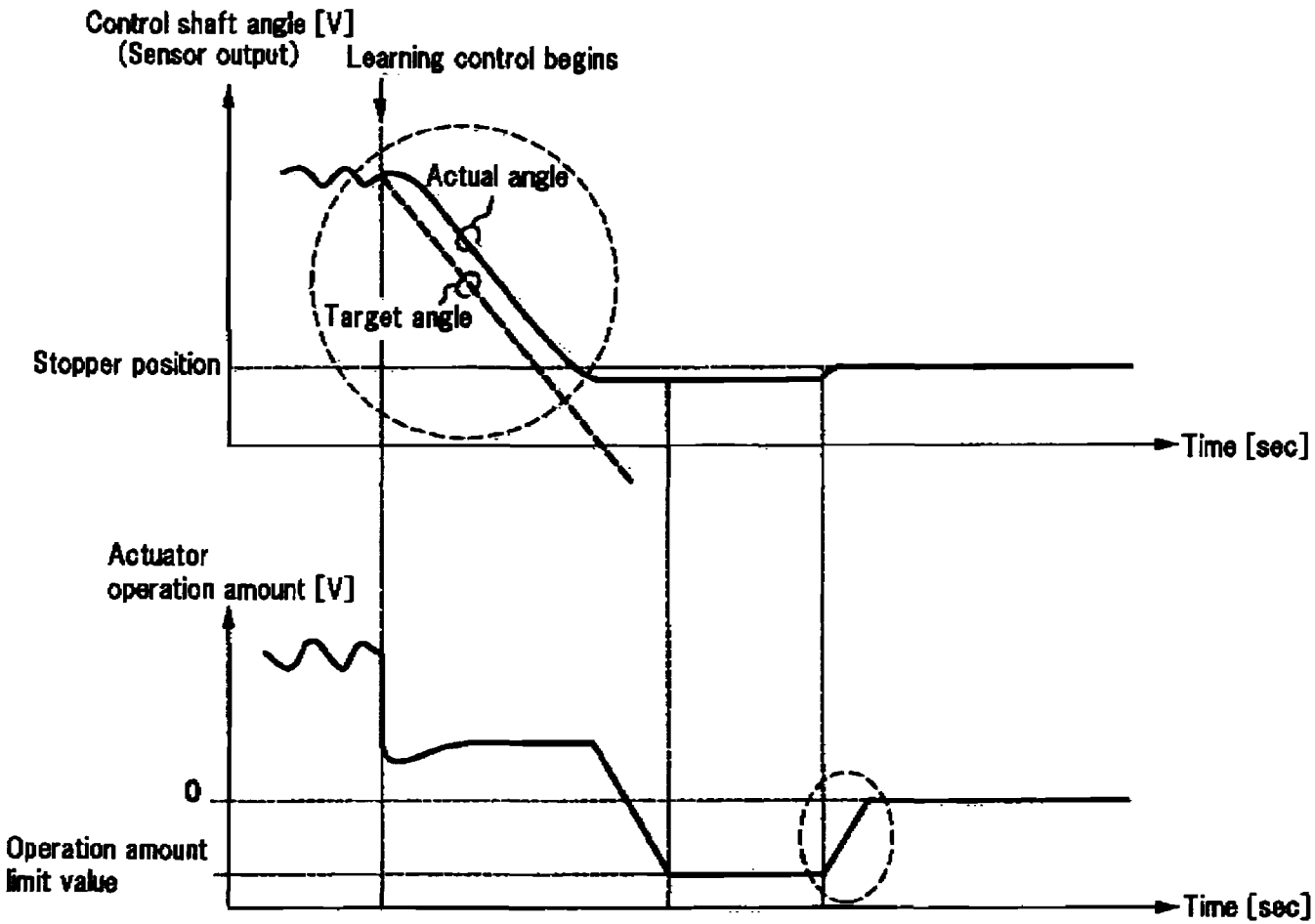
FIG. 7 is a time chart showing characteristics of the angle of a control shaft and a motor operation amount in the learning process of the second embodiment.

In Step S203, the target rotation angle of control shaft 13 is forcibly changed in the valve lift amount reducing direction at a predetermined speed, and the duty ratio of operation signals of motor 17 is feedback-controlled in accordance with the target rotating angle (see FIG. 7).

The correlation between the duty ratio of operation signals of motor 17 and motor torque in the second embodiment is the same as that of the first embodiment, and the feedback control of the duty ratio should be conducted in the same manner as in the first embodiment.

In Step S204, it is Judged whether or not the target rotating angle of control shaft 13 is lowered to the threshold value or less.

The threshold value is a value at which the valve lift amount becomes less than the minimum valve lift amount.

In the case where the target rotating angle has come down to the threshold value or less, control proceeds to Step S205.

In Step S205, it is determined whether or not the duty ratio of operation signals of motor 17 sticks to the limiter (<0) as described in connection with the first embodiment (see FIG. 7).

In this event, if the target rotating angle of control shaft 13 is decreased to the threshold value or less and the duty ratio sticks to the limiter, it is judged that control shaft 13 is pressed against stopper 13*b* and control proceeds to Step S206.

In Step S206, similarly to Step S109, it is judged whether or not signals of angle sensor 133 are stable in the vicinity of signals at the stopper position.

If the signals of angle sensor 133 are stable, control proceeds to step S207 and an OFF command of motor 17 is set.

As a result, control proceeds to Step S202 and then, ft is judged that the OFF command is set and control proceeds to Step S208.

Note that, instead of Judging whether or not the signals of angle sensor 133 are stable, it is possible to judge whether or not the condition that the target rotating angle is decreased to the threshold value or less and the duty ratio sticks to the limiter (<0) has continued for a predetermined time or more.

In Step S208, whether or not the duty ratio (applied electric voltage) is zero is determined and In the event that the duty ratio (applied electric voltage) has not reached zero, control proceeds to step S211, the duty ratio is brought to zero, and electric power supply to motor 17 is interrupted.

Because the duty ratio is brought to zero, from the next time, control proceeds from step S208 to step S209.

In Step S209, it is judged whether or not the signals of angle sensor 133 are stable in the vicinity of signals at the stopper position.

In the event that the signals of angle sensor 133 are judged to be stable, control proceeds to Step S210 and then-signals of angle sensor 133 are stored as signals at the position (stopper position) where rotation of control shaft 13 is restricted by stopper 13*b* (see FIG. 7).

When the signals at the stopper position are stored, correlation between the signals of angle sensor 133 and the rotation angle (valve life amount) of control shaft 13 is modified on the basis of the signals stored previously, and based on the correlation after the modification, the rotation angle (valve lift amount) of control shaft 13 is acquired from the signals of angle sensor 133.

Also in the above-mentioned embodiment, after pressing control shaft 13 against stopper 13*b* by motor torque, electric power supply to motor 17 is interrupted, and thereby deflection at the sensor mounting section is alleviated. Therefore, ft is possible to avoid fluctuation of sensor output due to deflection, and the sensor signals at the stopper position are learned highly accurately.

Furthermore, based on the target rotating angle (target valve lift amount) and the duty ratio of motor 17, it is judged whether or not control shaft 13 is pressed against stopper 13*b* by motor torque. Therefore, ft is possible to reduce motor torque when the condition that control shaft 13 comes in contact with stopper 13*b* is definitely achieved, and this can also improve the learning accuracy.

In the above-mentioned second embodiment, instead of interrupting electric power supply to motor 17, the duty ratio of motor 17 is returned from the limiter to a default (0>default>limiter) and motor torque that presses control shaft 13 against stopper 13*b* can be reduced.

Furthermore, in the second embodiment, the minimum valve lift position is learned but in the event that the rotation of control shaft 13 in the valve lift amount increasing direction is restricted by stopper 13*b*, the sensor signal at this maximum valve lift position can be learned in the same manner.

Figure 8:
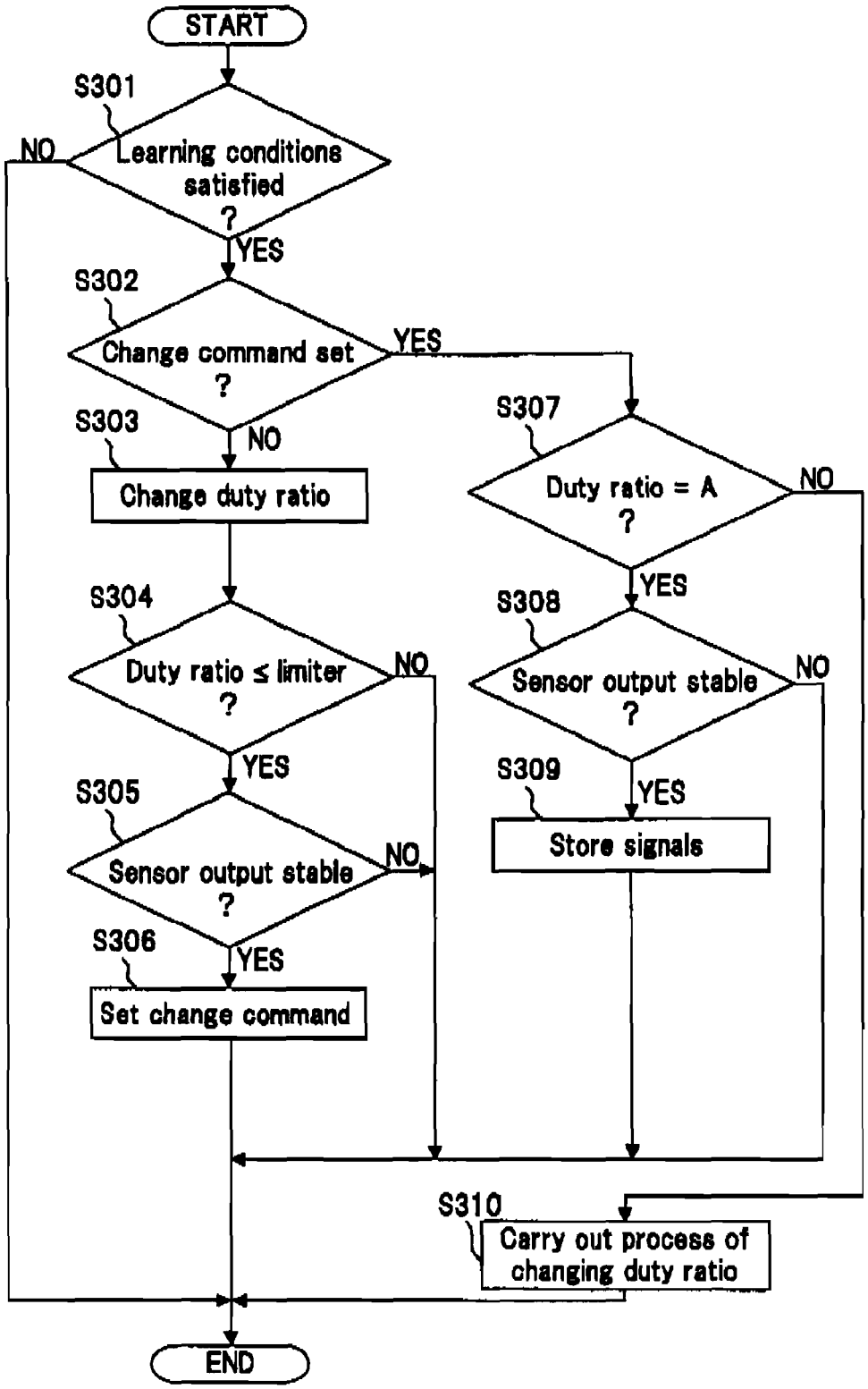
FIG. 8 is a flowchart of the teaming process according to a third embodiment of the present invention.

The flowchart of FIG. 8 shows a third embodiment of the learning process.

In the flowchart of FIG. 8, in Step S301, it is determined whether or not leaning conditions are satisfied.

The learning conditions which are determined here are, as in the second embodiment, to determine whether or not variable valve lift mechanism 112 and angle sensor 133 are normal, and at the same time, whether or not operating conditions do not greatly worsen the operability of engine 101 even if the valve lift amount of intake valve 105 is forcibly controlled to the minimum valve lift amount.

In Step S302, it is determined whether or not any change command of the duty ratio is set, and if no change command is set, control proceeds to Step S303.

In Step S303, the duty ratio of motor 17 is forcibly reduced at a predetermined speed from the value decided by regular feedback control.

That is, in the third embodiment, by the feedback control of the duty ratio towards the target rotating angle, the duty ratio of motor 17 is forcibly reduced instead of rotating control shaft 13 to the minimum valve lift position (stopper position), after which control shaft 13 is rotated to the stopper position.

Figure 9:
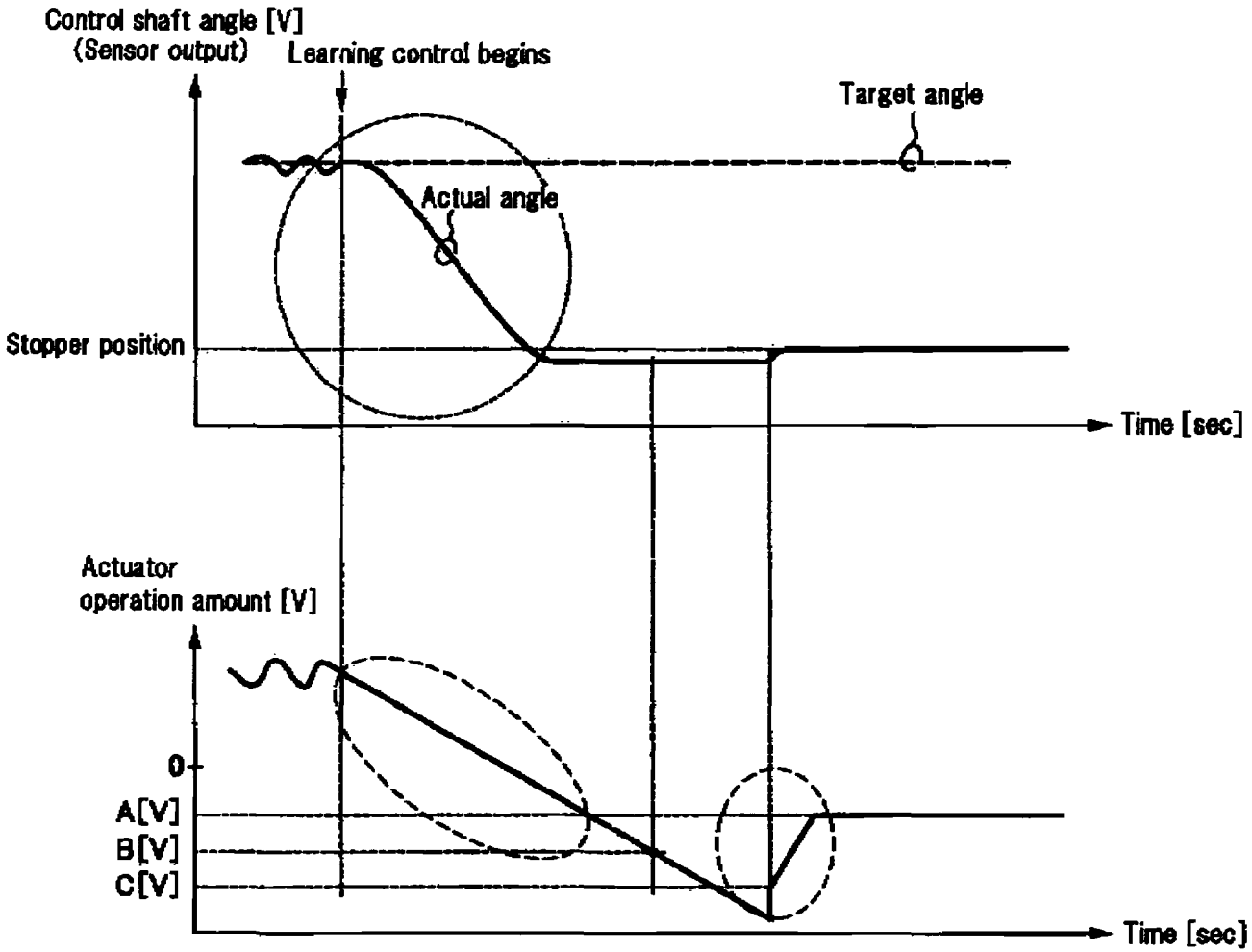
FIG. 9 is a time chart showing characteristics of the angle of a control shaft and a motor operation amount in the learning process of the third embodiment.

In Step S304, ft is judged whether or not the duty ratio of motor 17 has been lowered to a threshold value B or less (see FIG. 9).

The threshold value B is a negative value (<0) that causes generation of torque to rotate control shaft 13 in the valve lift amount reducing direction and is stored in advance as a duty ratio of an absolute value which can press control shaft 13 against stopper 13*b* with a pressing force greater than a predetermined force.

When in Step S304, it is judged that the duty ratio of motor 17 has been lowered to the threshold value B or less, control proceeds to step S305 and it is judged whether or not the output of angle sensor 133 is stable in the vicinity of the stopper position.

In this manner, it is confirmed whether or not control shaft 13 has been pressed against stopper 13*b* by the fact that the duty ratio of motor 17 has been lowered to the threshold value B or less.

In the event that the output of angle sensor 133 is stable, control proceeds to Step S308 and a change command of the duty ratio of motor 17 is set.

As a result, when control proceeds to Step S302 next time, control proceeds from Step S302 to Step S307, and in Step S307, it is determined whether or not the duty ratio of motor 17 has reached a threshold value A.

The threshold value A is less than 0 and more than the threshold value B, and is stored in advance as a value that generates pressurizing torque to stopper 13*b*, which does not generate excessive deflection at the sensor mounting section.

In Step S307, in the event that it is judged that the duty ratio of motor 17 has not reached the threshold value A, control proceeds to Step S310, and a process of changing the duty ratio of motor 17 from the threshold value B to the threshold value A is carried out.

In the change process of Step S310, after the duty ratio is changed from the current duty value to a threshold value C (0>threshold value A>threshold value B>threshold value C) in a stepwise manner, the duty ratio is increased and varied at a predetermined speed from the threshold value C to the threshold value A, deflection at the sensor mounting section is gradually reduced (see FIG. 9), and any impact generated at the moment of reduction in deflection is thereby alleviated.

Note that, instead of changing the duty ratio in a stepwise manner from the current value to the threshold value C and then gradually changing it to the threshold value A, it is possible to change the duty ratio stepwise from the value obtained when control proceeds to Step S310 to the threshold value B and thereafter to gradually change it to the threshold value A, or to return the value stepwise to the duty ratio obtained when execution judgment is made in Step S306 and then to gradually change it to the threshold A.

When the duty ratio of motor 17 is changed to the threshold value A in the process of Step S310, from the next time, control proceeds from Step S307 to Step S308, and it is judged whether or not the output of angle sensor 133 is stable in the vicinity of the stopper position.

If the output of angle sensor 133 is stabilized, control proceeds to Step S309, and the then-signals of angle sensor 133 are stored as signals at the position where rotation of control shaft 13 is restricted by stopper 13*b*, that is, signals at the minimum valve lift position (see FIG. 9).

According to the third embodiment, after control shaft 13 is securely pressed against stopper 13*b*, the pressing torque is alleviated and with control shaft 13 pressed against stopper 13*b* with weak force, sensor signals are learned. Therefore, degradation of learning accuracy caused by deflection of the sensor mounting section can be well avoided, and even during engine running, the minimum valve lift condition (pressing condition against stopper 13*b*) can be stably maintained.

In addition, this is not the configuration to change the duty ratio of motor 17 to the minimum valve lift position (stopper position) by varying the target of feedback control. Therefore, the duty ratio of motor 17 can be varied by optional characteristics, and deflection of the sensor mounting section can be alleviated at desired characteristics while definite pressing of control shaft 13 against stopper 13*b* is achieved.

Note that, it is possible to update the limiter and the threshold values A, B, and C from the duty ratio obtained when the sensor signal begins to be stabilized in the vicinity of the minimum valve lift position (stopper position).

In addition, in the case where the target valve lift amount is varied in the first and second examples and the duty ratio is varied towards the threshold value B in the third example, it is possible to reduce impact generated when control shaft 13 collides against stopper 13*b* in such a manner that these values are varied at a high speed at the beginning and when it is judged that there is a possibility for control shaft 13 to collide against stopper 13*b*, the changing speed of the target valve lift amount and the duty ratio is changed to a slower speed.

The entire contents of Japanese Patent Application No. 2006-344115, filed Dec. 21, 2006 are incorporated herein by reference.

While only selected embodiments have been chosen to illustrate the present invention, it will be apparent to those skilled in the art from this disclosure that various change and modification can be made herein without departing from the scope of the invention as defined in the appended claims.

Furthermore, the foregoing description of the several embodiments according to the present invention are provided for illustration only, and not for the purpose of limiting the invention as defined by the appended claims and their equivalents.

We claim:

1. An apparatus for learning a reference position of a variable valve unit provided with a variable valve mechanism that varies opening characteristics of an engine valve of an engine by rotary motion of a control shaft, an actuator that generates a rotary motion of the control shaft, a stopper that is arranged to restrict the rotary motion of the control shaft, and an angle sensor that is capable of outputting signals corresponding to angle positions of the control shaft, comprising:

a drive control unit that is configured, upon a condition that the engine is stopping, to control the actuator such that the rotary motion of the control shaft reaches a state where said control shaft is pressed against the stopper and then reduce drive torque of the actuator; and a learning unit that learns signals of the angle sensor, under a condition that the drive torque of the actuator is reduced by the drive control unit, as signals at a reference position where the rotary motion of the control shaft is restricted by the stopper.

2. The apparatus for learning a reference position of a variable valve unit according to claim 1, wherein the drive control unit judges whether or not the control shaft is pressed against the stopper based on an operation amount of the actuator and reduces the drive torque of the actuator in case where it is judged that the control shaft is pressed against the stopper.

3. The apparatus for learning a reference position of a variable valve unit according to claim 2, wherein the drive control unit judges that the control shaft is pressed against the stopper when said operation amount reaches a predetermine value and the signals of the angle sensor are stable.

4. The apparatus for learning a reference position of a variable valve unit according to claim 1, wherein the drive control unit judges whether or not the control shaft is pressed against the stopper based on the signals of the angle sensor and reduces the drive torque of the actuator in case where it is judged that the control shaft is pressed against the stopper.

5. The apparatus for learning a reference position of a variable valve unit according to claim 1, wherein the learning unit learns the signals of the angle sensor as signals at the reference position after the drive torque of the actuator is reduced and at the same time when the signals of the angle sensor are stable.

6. The apparatus for learning a reference position of a variable valve unit according to claim 1, wherein the actuator is a motor, and the drive control unit turns off electric power supply to the motor to thereby reduce drive torque.

7. The apparatus for learning a reference position of a variable valve unit according to claim 1, wherein the drive control unit gradually reduces the drive torque of the actuator.

8. The apparatus for learning a reference position of a variable valve unit according to claim 1, wherein the drive control unit restricts an operation amount of the actuator when the control shaft is pressed against the stopper.

9. The apparatus for learning a reference position of a variable valve unit according to claim 1, wherein the drive control unit controls the actuator to allow the control shaft to perform the rotary motion towards a target angle position exceeding an angle position at which the rotary motion is restricted by the stopper and thereby presses the control shaft against the stopper.

10. The apparatus for learning a reference position of a variable valve unit according to claim 1, wherein the drive control unit varies an operation amount of the actuator such that an angle position of the control shaft comes closer to an angle position where the rotary motion is restricted by the stopper thereby allowing the control shaft to be pressed against the stopper.

11. The apparatus for learning a reference position of a variable valve unit according to claim 1, wherein the drive control unit varies an operation amount of the actuator until a first reference amount is exceeded to thereby press the control shaft against the stopper, after which the operation amount is returned to a second reference amount to reduce the drive torque of the actuator.

12. A method for learning a reference position of a variable valve unit provided with a variable valve mechanism that varies opening characteristics of an engine valve by rotary motion of a control shaft, an actuator that generates a rotary motion of the control shaft, a stopper that is configured to restrict the rotary motion of the control shaft, and an angle sensor that is capable of outputting signals corresponding to angle positions of the control shaft, comprising the steps of:

controlling the actuator such that the control shaft is pressed against the stopper;

reducing drive torque of the actuator from a condition that the control shaft is pressed against the stopper; and learning signals of the angle sensor under a condition that the drive torque of the actuator is reduced as signals at a reference position where the rotary motion of the control shaft is restricted by the stopper, wherein the step of pressing the control shaft against the stopper includes the following steps of:

judging whether or not an engine switch is turned off; and controlling the actuator such that the control shaft is pressed against the stopper when the engine switch is turned off; and wherein the step of reducing the drive torque of the actuator includes the following steps of:

judging whether or not engine rotation stops; and reducing the drive torque of the actuator on condition that the engine rotation is at stopping.

13. The method for learning a reference position of a variable valve unit according to claim 12, wherein the step of reducing the drive torque of the actuator includes the following steps of:

judging whether or not the control shaft is pressed against the stopper based on an operation amount of the actuator; and reducing the drive torque of the actuator when the control shaft is judged to be pressed against the stopper.

14. The method for learning a reference position of a variable valve unit according to claim 12, wherein the step of reducing the drive torque of the actuator includes the following steps of:

judging whether or not an operation amount of the actuator has reached a predetermined value;

judging whether or not the signals of the angle sensor are stable; and reducing the drive torque of the actuator when the operation amount has reached the predetermined value and the signals of the angle sensor are stable.

15. The method for learning a reference position of a variable valve unit according to claim 12, wherein the step of reducing the drive torque of the actuator includes the following steps of:

judging whether or not the control shaft is pressed against the stopper based on the signals of the angle sensor; and reducing the drive torque of the actuator in case where the control shaft is judged to be pressed against the stopper.

16. The method for learning a reference position of a variable valve unit according to claim 12, wherein the step of learning the signals of the angle sensor includes the following steps of:

judging whether or not the drive torque of the actuator has been reduced;

judging whether or not the signals of the angle sensor are stable; and learning the signals of the angle sensor as signals at the reference position after the drive torque of the actuator is reduced and at the same time when the signals of the angle sensor are stable.

17. The method for learning a reference position of a variable valve unit according to claim 12, wherein the actuator is a motor, and the step of reducing the drive torque of the actuator includes the following step of:

turning off electric power source supply to the motor.

18. The method for learning a reference position of a variable valve unit according to claim 12, wherein the step of reducing the drive torque of the actuator includes the following step of:

gradually reducing the drive torque of the actuator.

19. The method for learning a reference position of a variable valve unit according to claim 12, wherein the step of pressing the control shaft against the stopper includes the following step of:

restricting an operation amount of the actuator when the control shaft is pressed against the stopper.

20. The method for learning a reference position of a variable valve unit according to claim 12, wherein the step of pressing the control shaft against the stopper includes the following step of:

controlling the actuator such that the control shaft is allowed to make rotary motion towards a target angle position exceeding an angle position at which the rotary motion is restricted by the stopper.

21. The method for learning a reference position of a variable valve unit according to claim 12, wherein the step of pressing the control shaft against the stopper includes the following step of:

varying an operation amount of the actuator such that the angle position of the control shaft comes closer to an angle position at which the rotary motion is restricted by the stopper.

22. The method for learning a reference position of a variable valve unit according to claim 12, wherein the step of pressing the control shaft against the stopper includes the following step of:

varying an operation amount of the actuator until a first reference amount is exceeded, and the step of reducing the drive torque of the actuator includes the following step of:

returning the operation amount to a second reference amount.

23. An apparatus for learning a reference position of a variable valve unit provided with a variable valve mechanism that varies opening characteristics of an engine valve of an engine by rotary motion of a control shaft, an actuator that generates a rotary motion of the control shaft, a stopper that restricts the rotary motion of the control shaft, and an angle sensor that is capable of outputting signals corresponding to angle positions of the control shaft, comprising:

a drive control means for, upon a condition that the engine is stopping, controlling the actuator such that the control shaft is pressed against the stopper and then reducing drive torque of the actuator; and a learning means for learning signals of the angle sensor, under a condition that the drive torque of the actuator is reduced by the drive control means, as signals at a reference position where the rotary motion of the control shaft is restricted by the stopper.

* * * * *